US006511348B1

(12) United States Patent
Wojtacki et al.

(10) Patent No.: US 6,511,348 B1
(45) Date of Patent: Jan. 28, 2003

(54) MODULAR JACK ASSEMBLY WITH SIGNAL CONDITIONING

(75) Inventors: Thomas Wojtacki, Greensboro, NC (US); Kevin J. Peterson, High Point, NC (US); Kurt T. Zarbock, Advance, NC (US); Joseph E. Geniac, Greensboro, NC (US); William J. Remaley, Walkertown, NC (US); Michael G. Pacyga, Clemmons, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/041,794

(22) Filed: Oct. 19, 2001

(51) Int. Cl.[7] ..... H01R 13/66
(52) U.S. Cl. ..... 439/620; 439/676; 439/541.5
(58) Field of Search ..... 439/620, 668, 439/676, 541.5, 953–954, 540.1, 542

(56) References Cited

U.S. PATENT DOCUMENTS 5,531,612 A 7/1996 Goodall et al. ..... 439/541.4
5,951,330 A * 9/1999 Reichard et al. ..... 439/676
6,022,245 A 2/2000 Minich ..... 439/620
6,059,581 A * 5/2000 Wu ..... 439/79
6,080,011 A * 6/2000 Tsao et al. ..... 439/541.5
6,132,260 A 10/2000 Wu ..... 439/676
6,193,560 B1 2/2001 Morana et al. ..... 439/676
6,206,725 B1 * 3/2001 Wu ..... 439/541.5
6,227,911 B1 5/2001 Boutros et al. ..... 439/620

* cited by examiner

*Primary Examiner*—Gary Paumen
*Assistant Examiner*—James R. Harvey

(57) ABSTRACT

The invention discloses a modular jack assembly comprised of an outer housing and a plurality of modular jack subassemblies. The modular jack subassemblies are comprised of an elongate beam support having a plurality of modular jack contacts on both sides thereof. The contacts extend into printed circuit board contacts and extend to and beyond the side edges of the elongate beam platform, leaving the space above and below the printed circuit board contacts and the beam support free, to accommodate signal conditioning componentry. Two printed circuit board modules are mounted orthogonally to the side edges of the beam support and include signal conditioning components. The assemblies are insertable into the housing defining modular jacks in the outer housing.

25 Claims, 16 Drawing Sheets

26
174
186
194
192
188
278d
277d
276d
275d
274d
273d
272d
271d
242
240
182
28
220
228
202a
201a
222
178
170
184
172
176
14
230
207
205
203
201
208
204
202
206

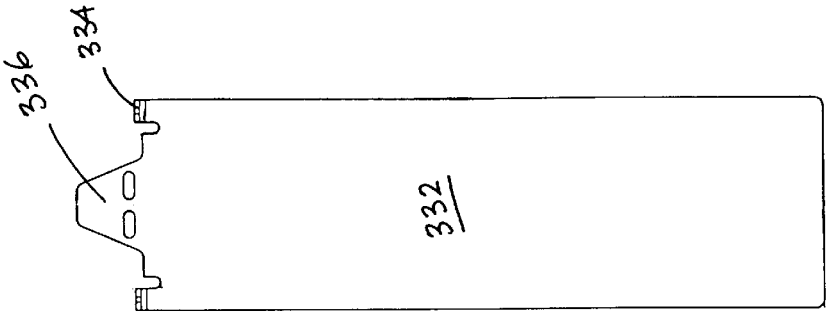
FIG 18
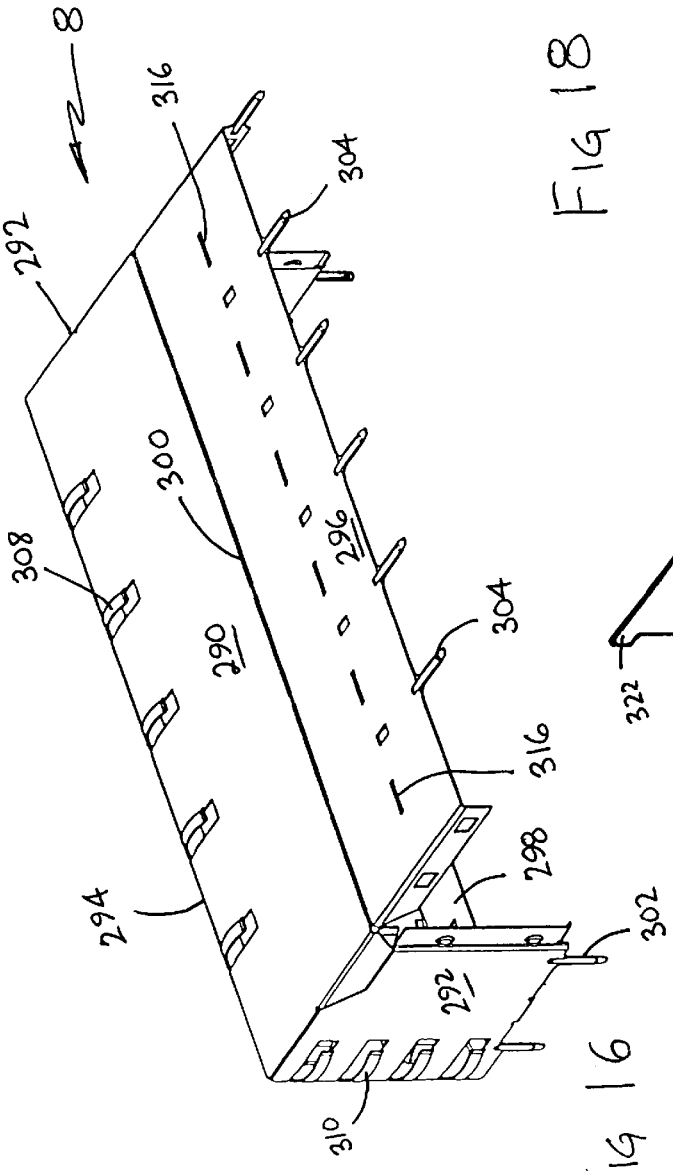
FIG 16
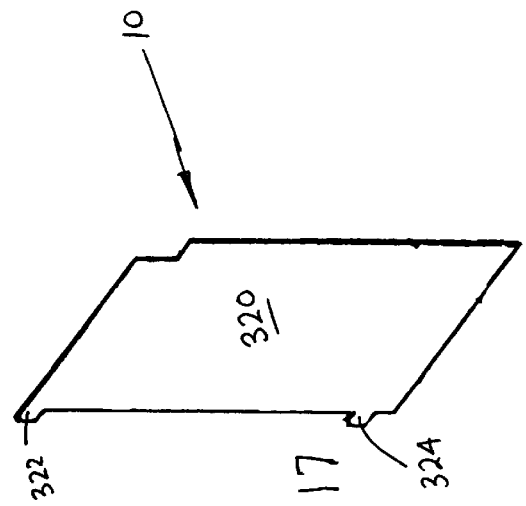
FIG 17
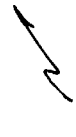

MODULAR JACK ASSEMBLY WITH SIGNAL CONDITIONING

BACKGROUND OF THE INVENTION

The invention relates to a connection assembly providing multiple port connections.

Known connector assemblies exist having multiple receptacle connectors in a common housing, which provides a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called stacked jack arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug-receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

One application for such connector assemblies is in the field of telephony wherein the modular jacks provide ports for connection with a telephone switching network of a telephone service provider, such as, a regional telephone company or national telephone company. The corresponding RJ-11 modular plugs terminate opposite ends of telephone cords leading to wall mounted telephone outlets inside a building. The telephone outlets connect to telephone lines outside of the building, which, in turn, connect to the telephone switching network of the telephone service provider.

Alternatively, such connection systems have found utility in office computer networks, where desktops are interconnected to office servers by way of sophisticated cabling. Such networks have a variety of data transmission medium including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore the volume within the assembly is inadequate to provide the proper signal conditioning devices for the high speeds now required.

The objects of the inventions are therefore to overcome the shortcomings of the prior art.

BRIEF SUMMARY OF THE INVENTION

The objects of the invention have been accomplished by providing an electrical connector assembly, which comprises a housing member having a front mating face having at least two openings therethrough, profiled to receive a plurality of electrical plugs, wherein the openings are positioned one above the other. A jack portion is comprised of an elongate beam section having a front face, rear face, top and bottom faces and side edges, transverse walls upstanding from the top and bottom faces, the top and bottom faces including terminal receiving channels therein, extending through the transverse walls, with vertical slots extending into the top and bottom transverse walls and communicating with the channels. The assembly also includes a plurality of electrical terminals positioned in the channels, having base portions lying in the channels substantially parallel to the top and bottom faces and extending through the transverse walls, with contact portions being reversely bent adjacent to the front face and extending rearwardly and being laterally aligned within the vertical slots. The jack portion, together with the terminals, is receivable within the housing member, with the upper row of contact portions positioned adjacent to the upper opening, and the lower row of contact portions adjacent to the lower opening.

In the preferred embodiment of the invention, the vertical slots extend only partially the length of the transverse walls, thereby forming stop surfaces for the contact portions, and the contact portions are spring-biased against the stop surfaces.

Also in the preferred embodiment of the invention, the connector housing member includes inner side walls flanking the openings, the side walls having slots profiled to receive portions of the jack portion side edges for aligning the jack portion and the terminals with the openings. The side edges include extension portions profiled for receipt within the slots. Preferably, the extension portions have side edges tapered towards the jack portion front face. Also preferably, the extension portions have top and bottom surfaces which together taper towards the jack portion front face. In the preferred embodiment, the extension portions include a retaining lug extending forwardly therefrom and the housing front mating face including receiving openings for receipt therethrough of the retaining lugs. The retaining lugs are adapted for heat staking the jack portion to said housing.

In another embodiment of the invention, an electrical connector housing, comprises a housing member having a front mating face having at least two openings therethrough, which are profiled to receive a plurality of electrical plugs through the front mating face, and the openings being profiled one above the other. A jack portion is comprised of an elongate platform beam section having a substantially rectangular profile, the jack portion has top and bottom surfaces having terminal-receiving channels therein. A plurality of electrical contacts are positioned in the terminal receiving channels, with contact portions adjacent a front end of the platform beam section, and rear contact sections being positioned substantially within the profile of the terminal receiving channels. The jack portion is receivable within the housing member, thereby defining cavities above and below the platform beam section, and between the housing member, for receiving circuit components for the contacts.

The housing member includes a plurality of columns of openings arranged in laterally spaced positions. Preferably, the housing member includes an intermediate wall parallel with the housing front mating face, and the platform beam section is receivable within the housing member, whereby plug receiving cavities are defined above and below the platform beam section, between the mating face and intermediate wall, and the circuit components receiving cavities are defined above and below the platform beam section, between the intermediate wall and a rear face of the housing member.

The plug receiving cavities are preferably further defined by side walls extending forwardly from the intermediate wall. The side walls have slots profiled to receive portions of the jack portion side edges for aligning the jack portion with the openings. The side edges include extension portions profiled for receipt within the slots. The extension portions have side edges tapered towards the jack portion front face, and have top and bottom surfaces which together taper towards the jack portion front face. The extension portions preferably include a retaining lug extending forwardly therefrom and the housing front mating face including receiving openings for receipt therethrough of the retaining lugs. The retaining lugs are adapted for heat staking the jack portion to said housing.

In yet another embodiment of the invention, an electrical connector housing, comprises a housing member having a front mating face having at least two openings therethrough, profiled to receive a plurality of electrical plugs through the front mating face, where the openings are profiled one above the other. A jack portion is comprised of an elongate platform beam section having a substantially rectangular profile, the jack portion having top and bottom surfaces having terminal receiving channels therein, and a shield receiving slot extending within the platform beam section, extending the substantial length of the platform beam section. A plurality of electrical contacts are positioned in the terminal receiving channels defining upper and lower rows of contacts, with contact portions adjacent a front end of the platform beam section. An isolation shield receivable within the shield receiving slot isolates electromagnetic interference between the upper and lower rows of contacts.

In the preferred embodiment of the invention, the electrical connector assembly further comprises an outer shield substantially surrounding the housing member, with openings through the shield member, in alignment with the plug receiving openings. The outer shield member is preferably electrically connected to the isolation shield. The shield member includes a front shield wall, top shield wall, side shield walls, and a rear shield wall. The isolation shield includes a tab contact receivable within a slot in the rear shield wall.

In the preferred version, the housing member includes an intermediate wall parallel with said housing front mating face, and said platform beam section is receivable within said housing member, whereby plug receiving cavities are defined above and below said platform beam section, between said mating face and intermediate wall, and circuit components receiving cavities are defined above and below said platform beam section, between said intermediate wall and a rear face of said housing member.

BRIEF DESCRIPTION OF THE DRAWINGS

FIG. 16 is a rear perspective view of the outer shield, as shown in FIG. 1;

FIG. 17 is a perspective view of the side shields which are positionable between adjacent connector subassemblies;

FIG. 18 is a plan view of the isolation shield which is positioned through the modular jack beam between the terminal arrays;

DETAILED DESCRIPTION OF THE EMBODIMENT

Figure 1:
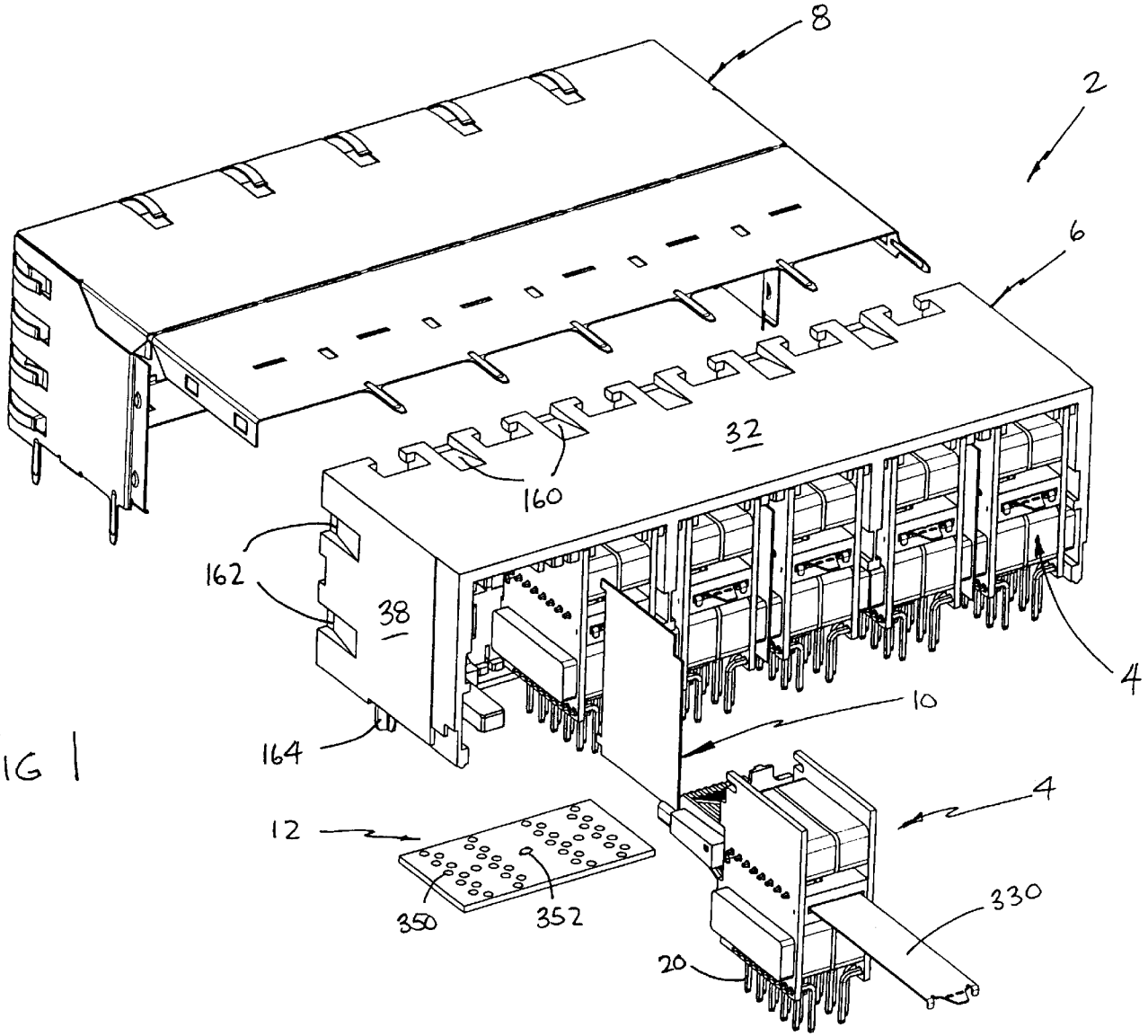
FIG. 1 is a perspective view of the connector assembly partially exploded to show the various components of the invention.

With reference first to FIG. 1, a stacked modular jack assembly is shown generally by reference numeral 2 and includes a plurality of modular jack subassemblies 4, a main housing member 6, and an outer shield member 8. The modular jack subassemblies 4 are positionable within the main housing 6 with an isolation shield 10 positioned between adjacent modular jack subassemblies 4, and with organizer boards 12 positioned below a pair of adjacent modular jack subassemblies 4 as described more fully herein. In the preferred embodiment of the invention, the modular jacks are in the RJ-45 configuration.

Figure 2:
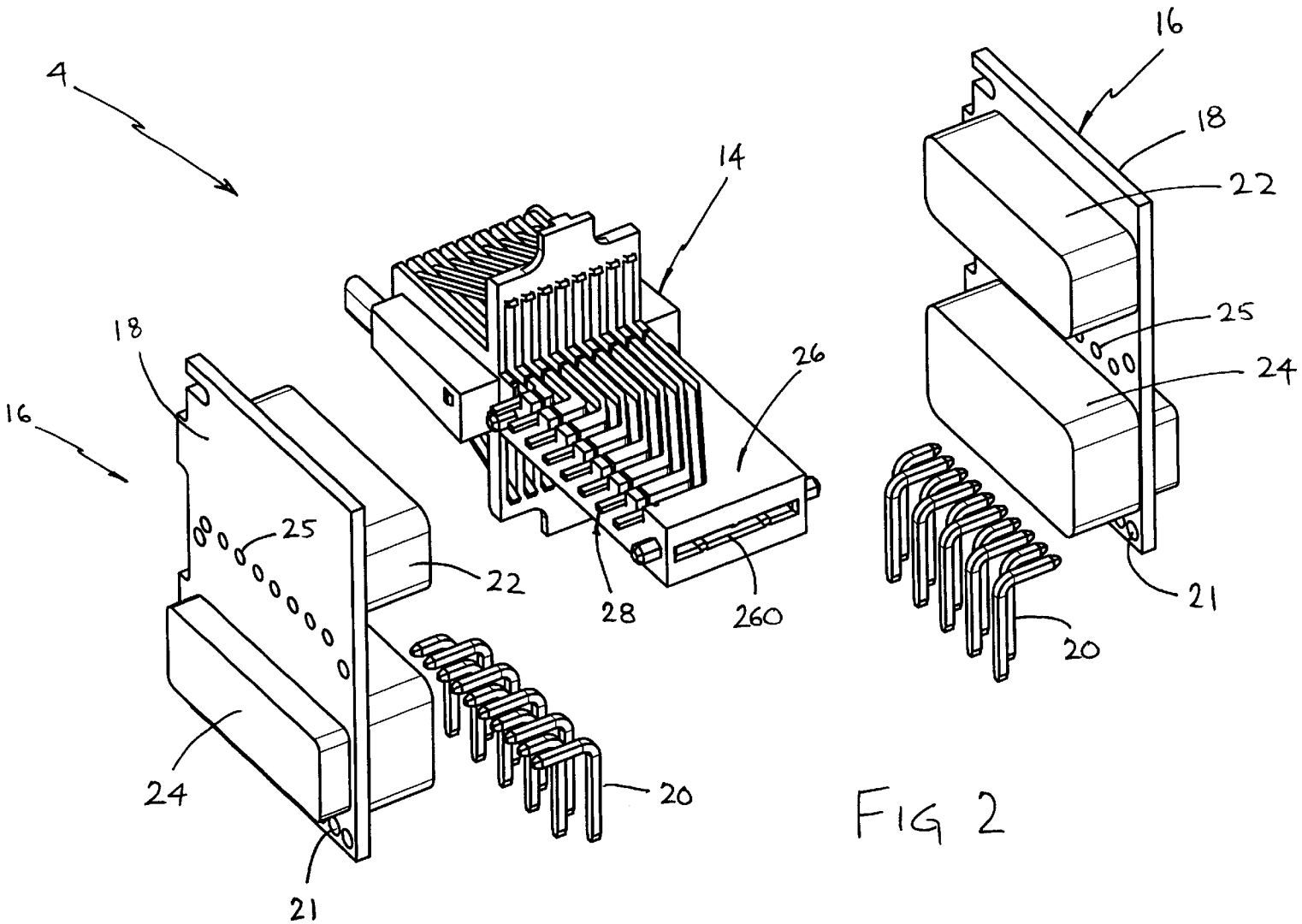
FIG. 2 is an enlarged perspective view of the connector subassembly exploded to show their various components.

With reference now to FIG. 2, the modular jack subassemblies 4 will be described in greater detail. The modular jack subassembly 4 is generally comprised of a modular jack connector member 14 which can be positioned within the housing 6, where the modular jack connector 14 is adapted to receive two signal conditioning assemblies 16 from opposite sides thereof. The signal conditioning assemblies 16 are generally comprised of a printed circuit board 18 having right-angled circuit board contacts 20 extending from, and interconnected to, the circuit board 18, at through holes 21, and passive filtering devices such as components 22 and 24. It should be appreciated that the boards include through holes such as 25, which are electrically connected through circuit traces (not shown), to the contacts 20. The modular jack connector 14 is generally comprised of a housing 26 having a plurality of contacts 28, such that the signal conditioning assemblies 16 may be mounted to the housing 26, with the contacts 28 interconnected to the through holes 25.

Figure 3:
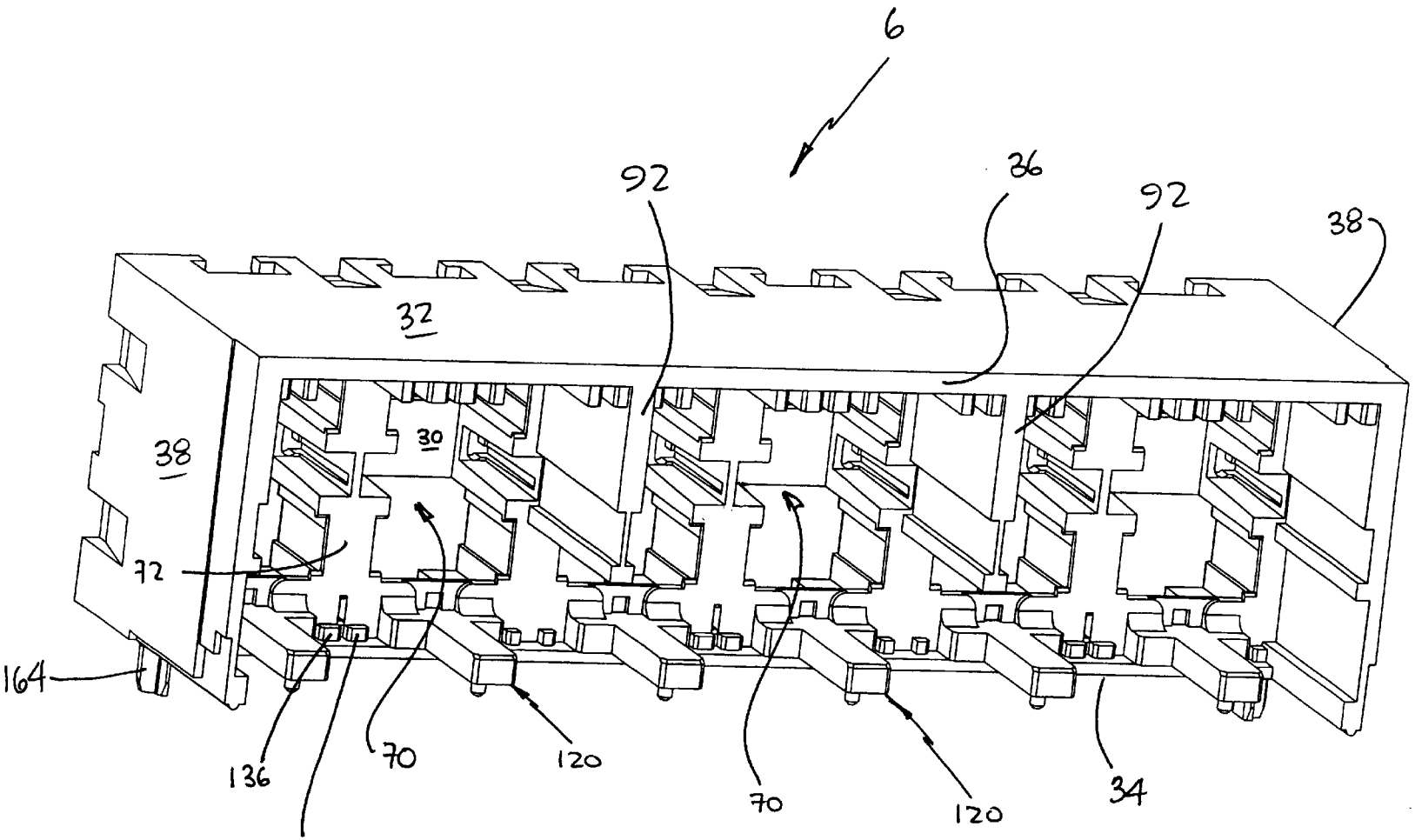
FIG. 3 is a rear perspective view of the main housing portion.
Figure 3A:
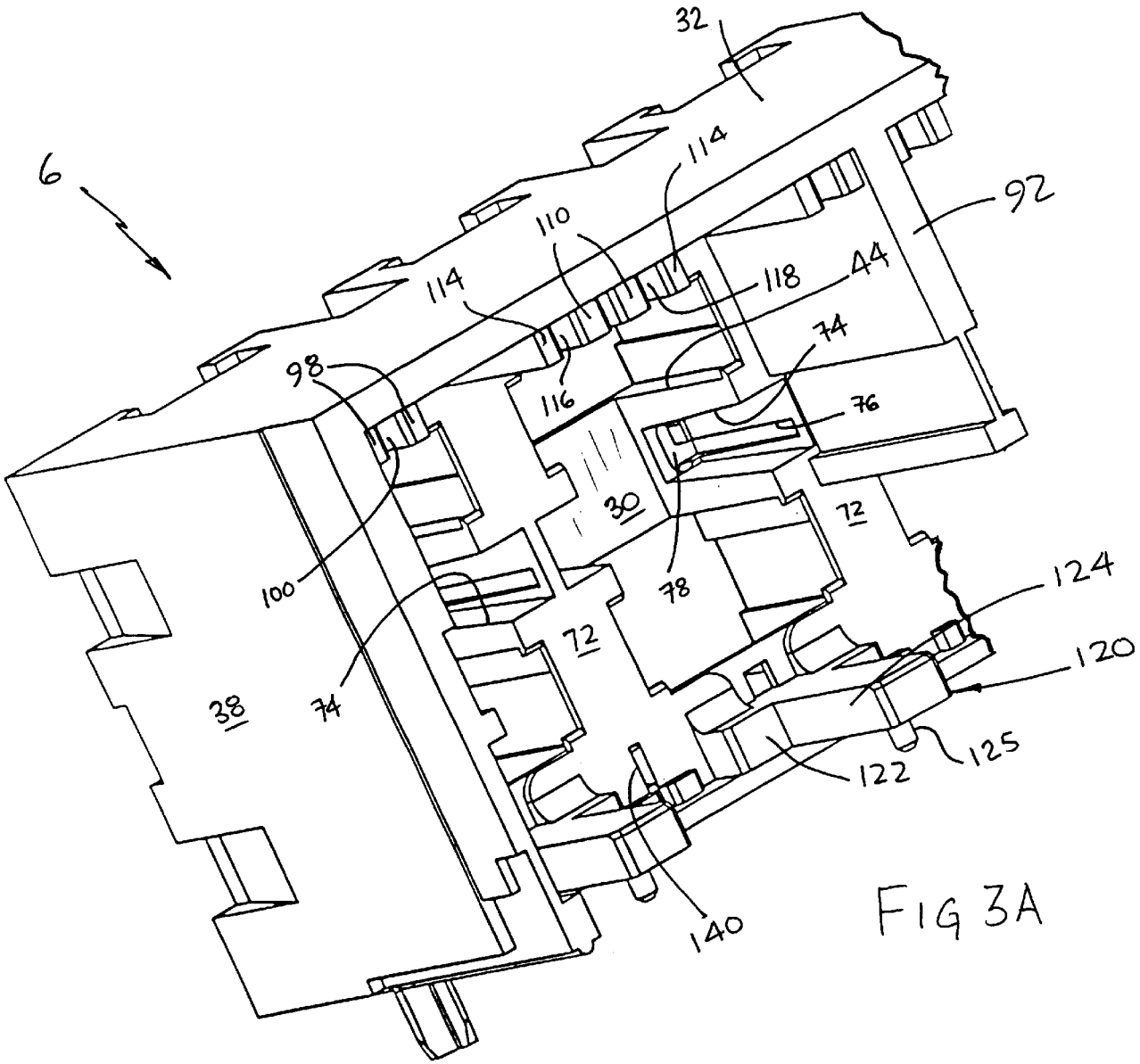
FIG. 3A is an enlarged view, in partial fragmentation, of the main housing portion shown in FIG. 3.
Figure 4:
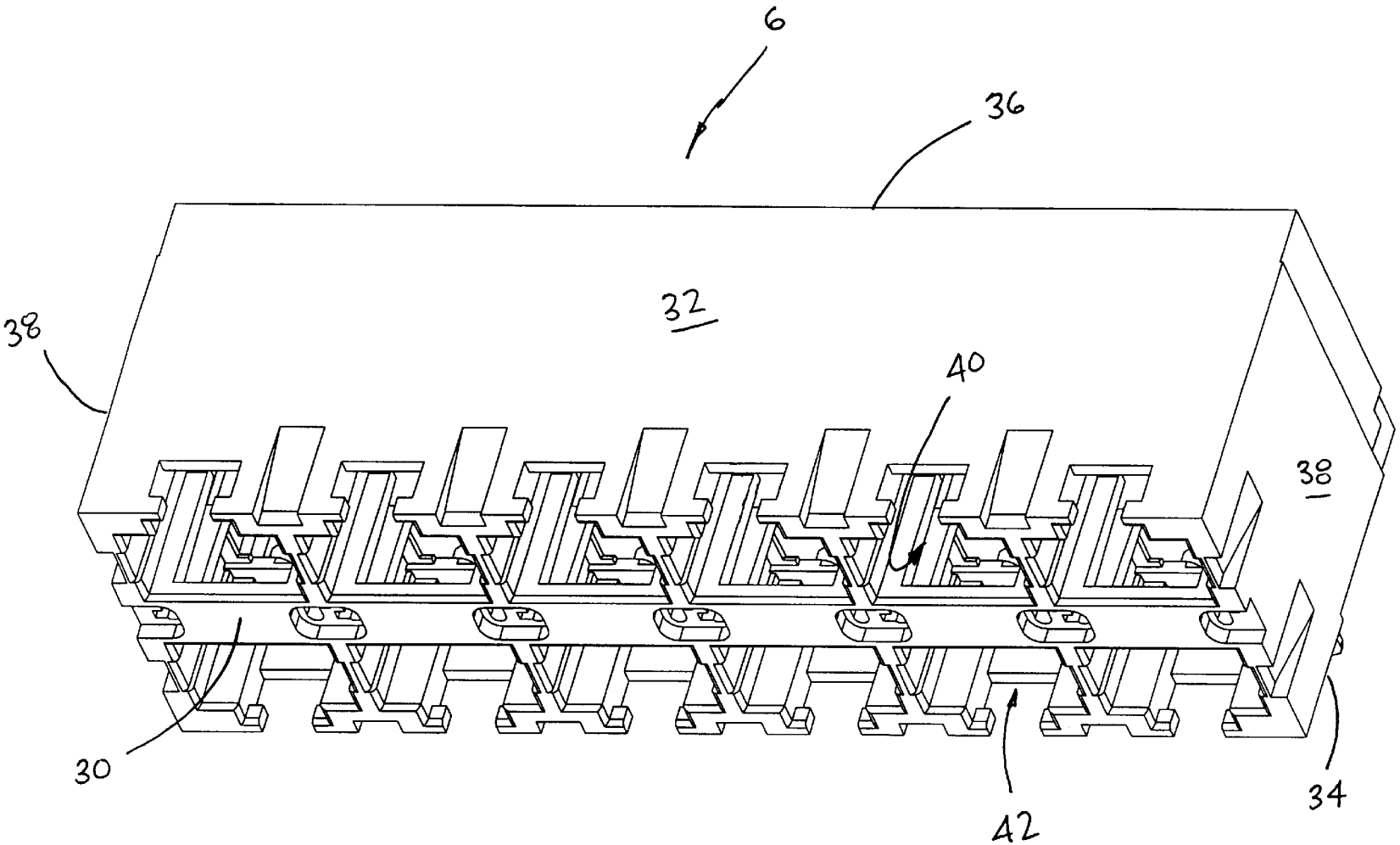
FIG. 4 is a front perspective view of the main housing portion.
Figure 4A:
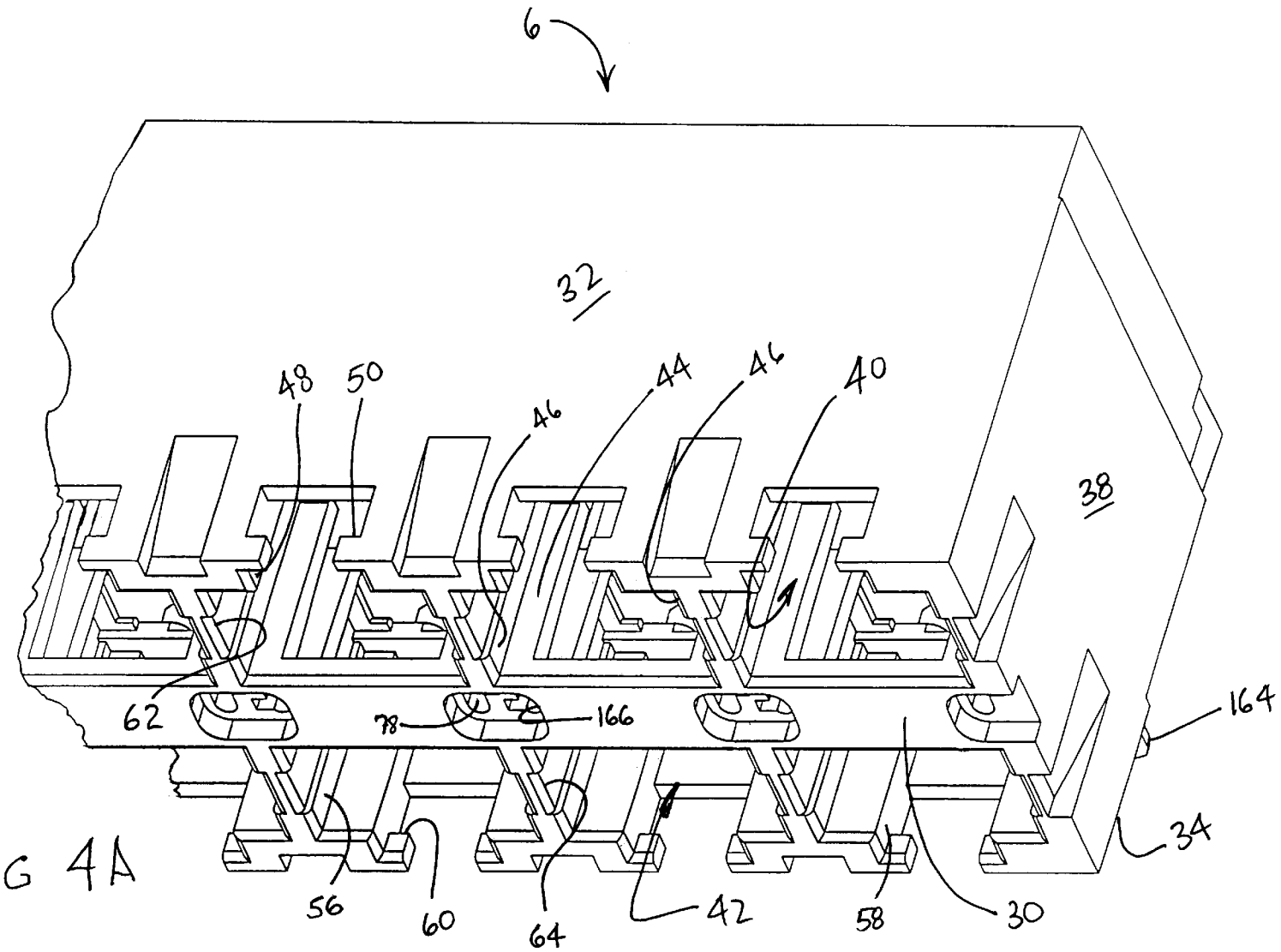
FIG. 4A is a view in partial fragmentation, of the main housing portion shown in FIG. 4.
Figure 5:
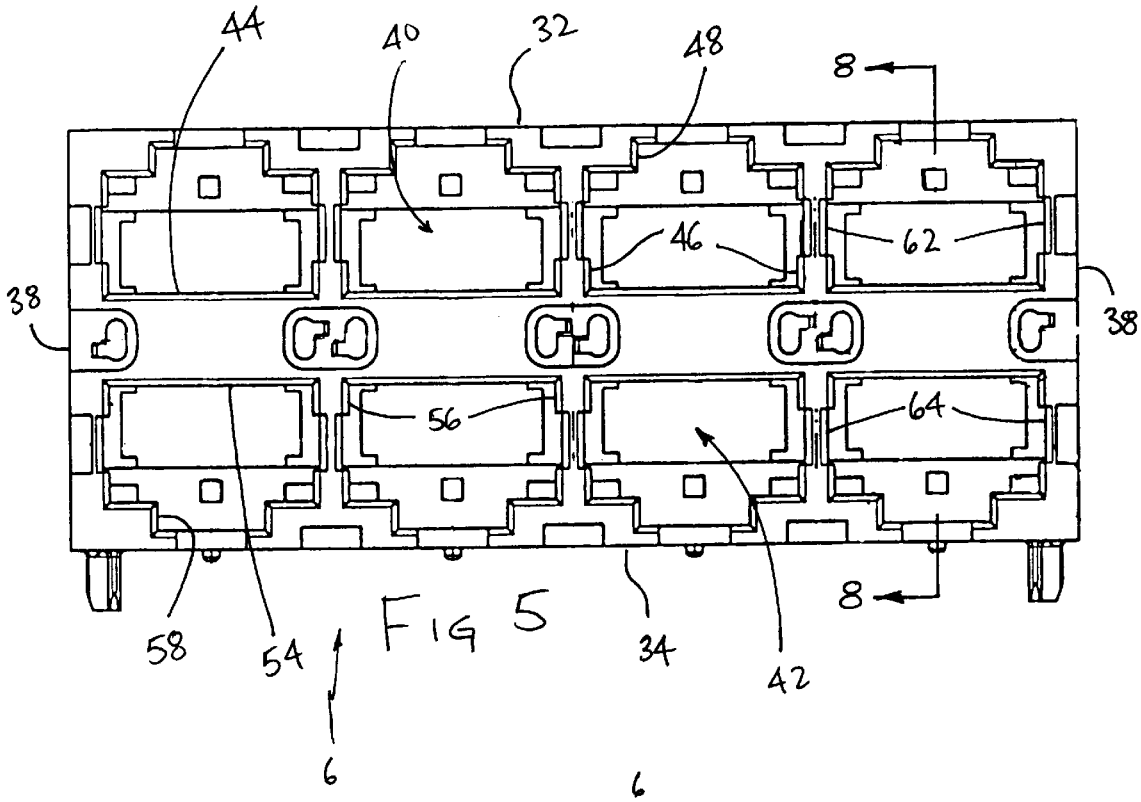
FIG. 5 is a front plan view of the housing shown in FIGS. 3 and 4.

With reference now to FIGS. 3, 3A and 4, 4A, the main housing member 6 will be described in greater detail. As shown in FIG. 4, the housing member 6 generally includes a front mating face 30, a top wall 32, a lower wall 34, a rear face 36, and end walls 38 (only one of which can be viewed in FIGS. 3A and 4A). With reference now to FIGS. 4A and 5, the front face 30 of the housing 6 is shown to include an upper row of modular plug receiving openings 40 and a lower row of modular plug receiving openings 42. The cavities 40 include a lower surface 44, inner parallel side surfaces 46, and a latch-receiving notch 48 together with a rearwardly facing latching surface 50. Similarly, the row of lower cavities 42 includes a top wall 54 (FIG. 5) and inner side walls at 56. A lower latch-receiving recess is provided at 58 with a rearwardly facing latch surface 60. Each of the cavities 40, 42 also includes slots 62 in side walls 46, and slots 64 in side walls 56, to accommodate the modular plug. It should be understood, however, that any such modification to the modular plug receiving openings could be modified to change the configuration of the plug or to accommodate different keying configurations.

Figure 7:
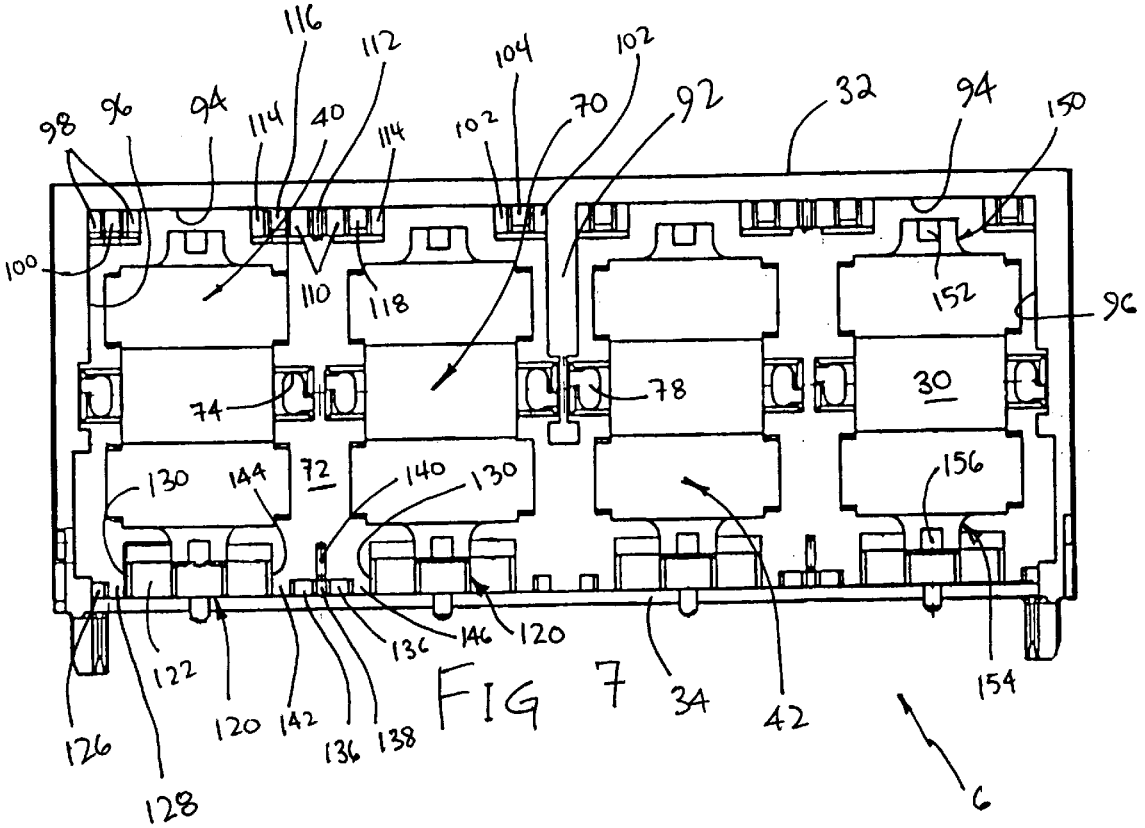
FIG. 7 is a rear perspective view of the housing of FIG. 5.
Figure 8:
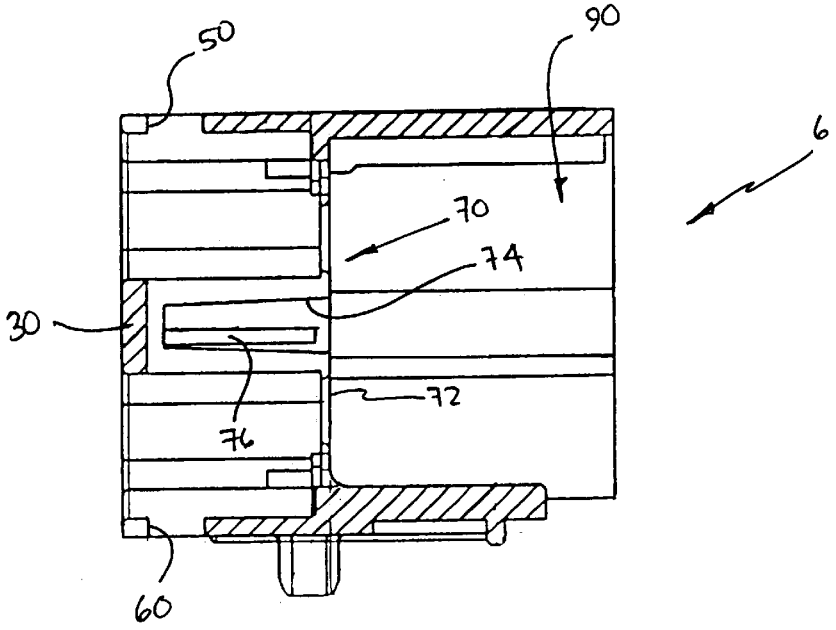
FIG. 8 is a cross-sectional view through lines 8—8 of FIG. 5.

With reference now to FIGS. 3, 3A, 7, and 8, a modular jack receiving area 70 will be described in greater detail. The modular jack receiving area 70 extends forwardly from an intermediate wall shown at 72 to an inner surface of the front wall 30. As shown in FIGS. 3A and 8, a tapered slot is defined at 74, which extends from the intermediate wall 72 towards the front wall 30. The tapered slot also includes a narrow receiving slot 76, described more fully herein. The tapered slot 74 extends forward, and then through the front wall 30 to form an oval-shaped opening at 78 (FIG. 3A).

With respect now to FIGS. 3, 7 and 8, a rear enlarged compartment is shown generally at 90, and extends rearward from the center wall 72. The enlarged areas 90 are separated by intermediate walls 92, which in the preferred embodiment, are positioned to separate side-by-side pairs of openings 40, 42. This enlarged volume exists between inner surface 94 of upper wall 32, inner surfaces 96 of side wall 38, and between intermediate walls 92.

Figure 6:
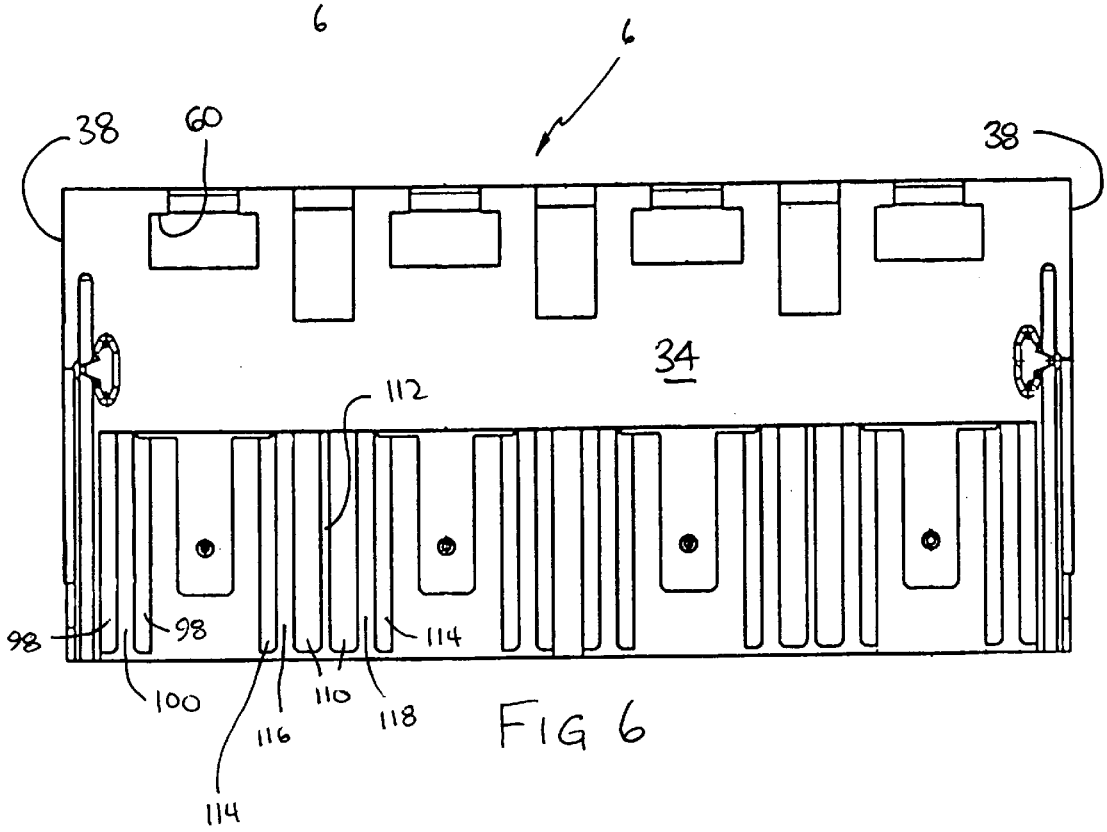
FIG. 6 is a bottom plan view of the housing of FIG. 5.

As shown in FIGS. 3A, 6 and 7, a plurality of aligning devices are provided to align the connector subassembly 4 and intermediate shield 10, with the housing 6. As shown best in FIGS. 6 and 7, a pair of ribs 98 extend rearwardly from the intermediate wall 72 and are positioned in the corner defined by inner surface 96 and upper surface 94, and are spaced apart so as to define a slot at 100. In the adjacent corner that is defined between surface 94 and intermediate wall 92, ribs 102 also define an intermediate slot at 104. Also centrally located between the surfaces 96 and intermediate wall 92 are pairs of ribs, that is, a centrally positioned pair of ribs 110, which defines a central slot 112, and outer ribs 114, which flank the central ribs 110, to define two intermediate slots, that is, 116 and 118. This configuration is repeated in adjacent enlarged areas 90 between each intermediate wall 92, and thus only one such area is described.

With respect now to FIGS. 3A and 7, complementary aligning features are provided extending upwardly from the lower wall 34 to cooperate with the locating features for the connector subassembly 4 and shield 10 as described above. As shown in FIG. 3A, the connector housing 6 includes a T-shaped projection 120, including a transverse portion 122, and a board support portion 124, having a support peg 125. A rib 126 (FIG. 7) is provided such that a slot 128 is defined between rib 126 and side wall 130 of transverse portion 122. With reference still to FIG. 7, two ribs 136 define therebetween slot 138, and a further slot 140 projects into back wall 72. It should be appreciated that slots 138 and 140 are in vertical alignment with slot 112. Furthermore, a slot 142 is defined between side surface 144 of transverse portion 122 and rib 136; and a slot 146 is defined between rib 136 and side surface 130 of the adjacent projection 120. It should be appreciated too that slots 116 and 142; and 118, 146 are in vertical alignment with each other. The housing 6 also includes an upper contoured recess 150 having an aperture at 152 and a lower contoured recess 154 having an aperture at 156, as shown best in FIG. 7.

Finally, as shown in FIG. 1, housing 6 includes a plurality of recesses 160 positioned along the top surface of upper wall 32 and includes recesses 162 extending into side wall 38. Furthermore, housing 6 includes printed circuit board locating lugs 164 extending downwardly therefrom, and as shown in FIG. 4A, includes recesses 166 encircling two adjacent pairs of oval recesses 78.

Figure 9:
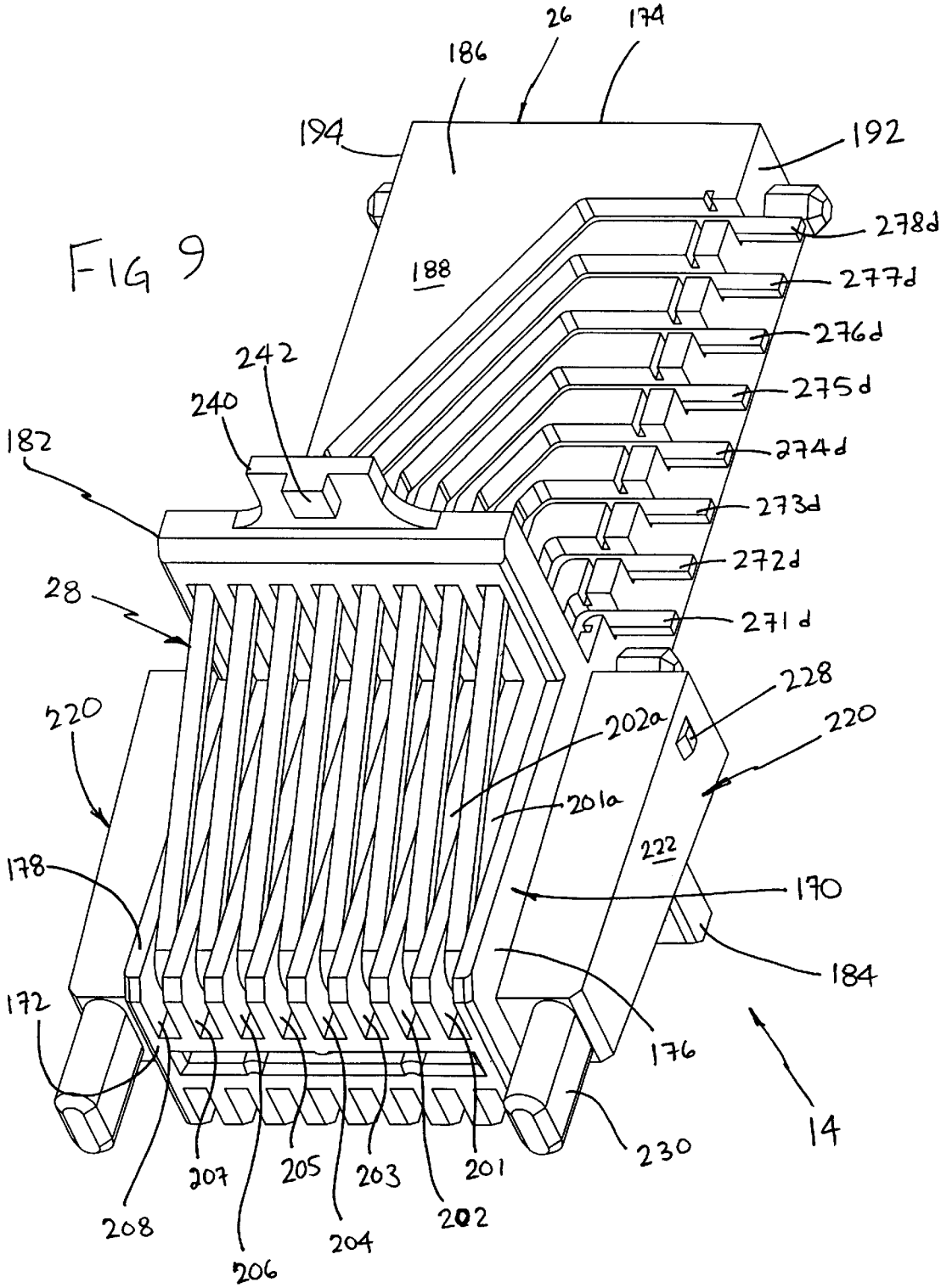
FIG. 9 is a front perspective view of the modular jack subassembly.

With reference now to FIG. 9, the modular jack connector 14 is shown, with housing 26 including an elongate platform housing portion, or beam portion 170, which generally extends between a front mating face 172 and an end face 174. The elongate housing portion 170 includes a front mating section 176 having a top surface at 178 and a lower surface at 180 (FIGS. 12 and 13), where an upper transverse wall 182 extends upwardly from surface 178, and a lower transverse wall 184 extends downwardly from surface 180. The elongate platform portion 170 further includes a rear platform portion 186, which includes an upper face 188, a lower face 190 (FIG. 12), and two transverse faces 192, 194 (FIG. 9) as described in greater detail herein.

Figure 10:
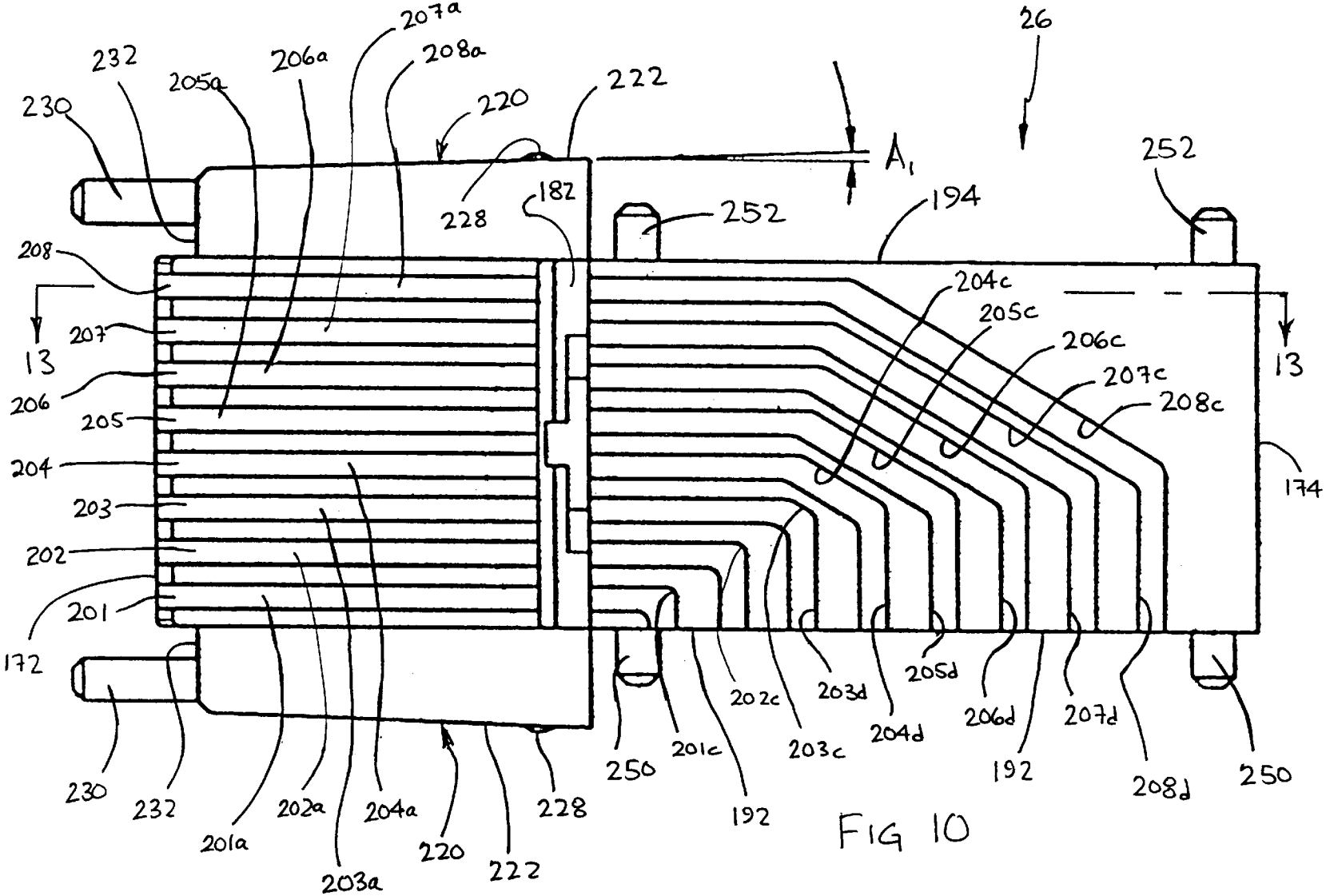
FIG. 10 is a top plan view of the connector housing of FIG. 9 without the contacts loaded.
Figure 11:
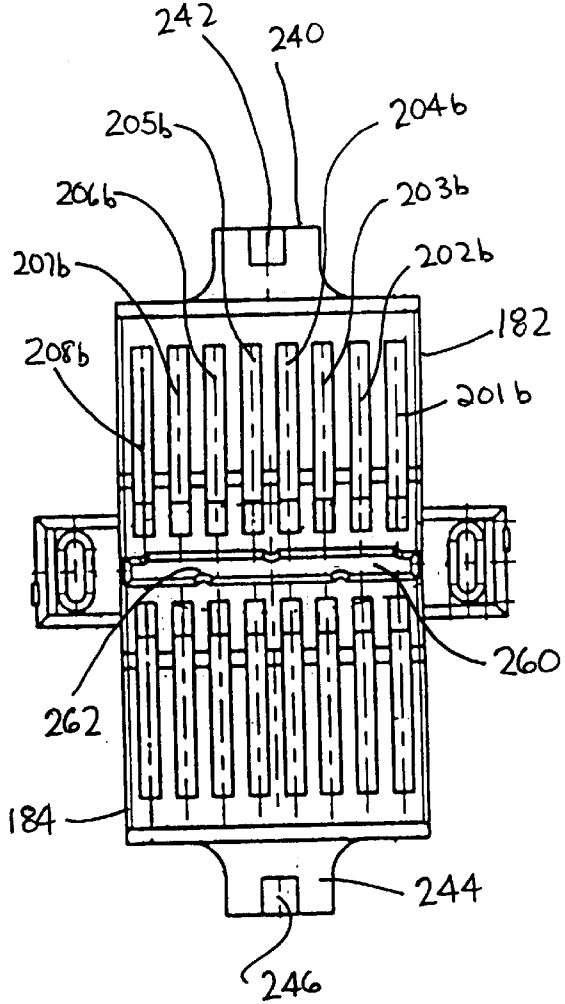
FIG. 11 shows a front plan view of the housing of FIG. 10.

As shown best in FIG. 10, the modular jack housing 26 includes a plurality of slots 201–208, which extend from front face 172 rearwardly towards end face 174. The slots 201–208 include linear portions 201A–208A, extending rearwardly through upstanding wall 182 as shown in FIGS. 10 and 11. As shown best in FIG. 11, the slots 201–208 also include upper vertical portions 201B–208B, which form contact alignment slots as described herein. After extending through the upper transverse wall 182, the linear slot portions 201A–208A include transition sections, for example, 201C–208C, and thereafter right-angled sections 201D–208D, which open onto side face 192, as best shown in FIG. 10. It should be appreciated that lower face 190 includes an identical array of slots such as 201–208, with the exception that the slots are mirror-imaged, such that the slots extend through lower transverse wall 184, and open onto transverse face 194.

Figure 12:
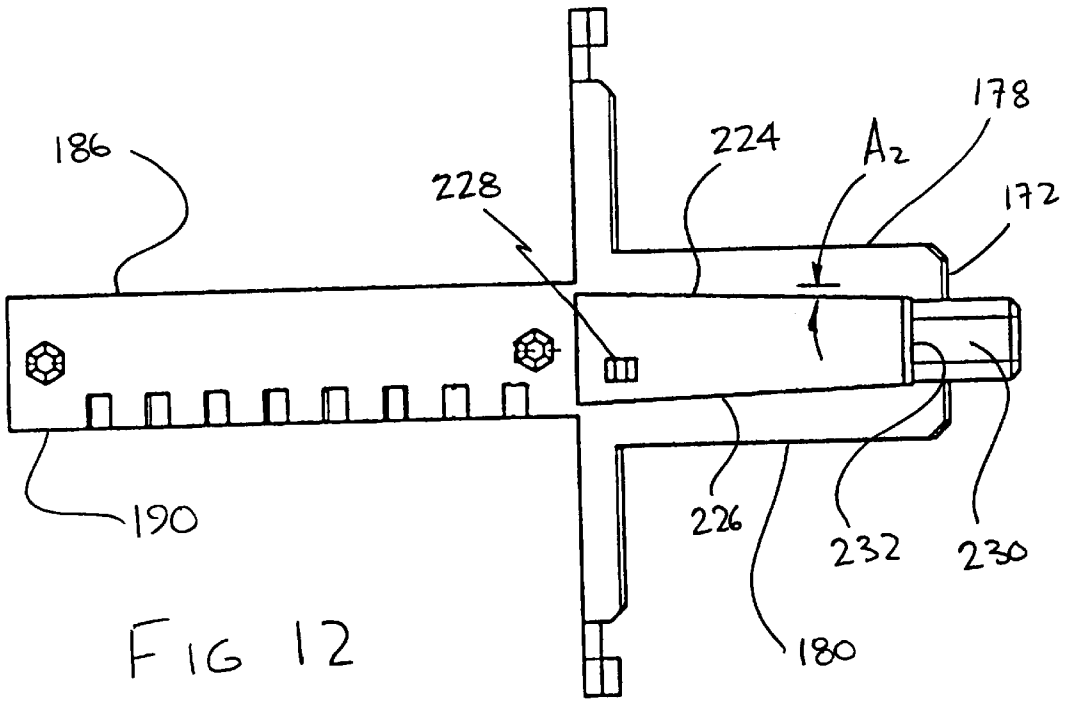
FIG. 12 is a side plan view of the housing of FIGS. 10 and 11.

With respect now to FIGS. 9 through 13, the retention features of modular jack housing 26 will be described in greater detail. As shown first in FIG. 9, the housing 26 includes two side extensions, 220 extending along the front housing portion 176 and includes side surfaces 222 which taper towards front face 172 by angle $A_1$ (FIG. 10) and include top and bottom surfaces 224, 226 which also taper towards front face 172 by angle $A_2$ (FIG. 12). Each side surface 222 further includes a detent mechanism 228 adjacent the end of the side extensions 220. Each of the side extensions 220 further includes an oval-shaped heat stake lug 230 extending from a front end face 232 of the side extensions 220.

As shown best in FIGS. 9 and 11, transverse wall 182 includes a contoured wall portion 240 having an extension lug 242, whereas lower transverse wall portion 184 includes a contoured wall section 244 having lug member 246. Furthermore, transverse face 192 includes locating lugs 250, whereas transverse face 194 includes locating lugs 252.

Figures 13, 15:
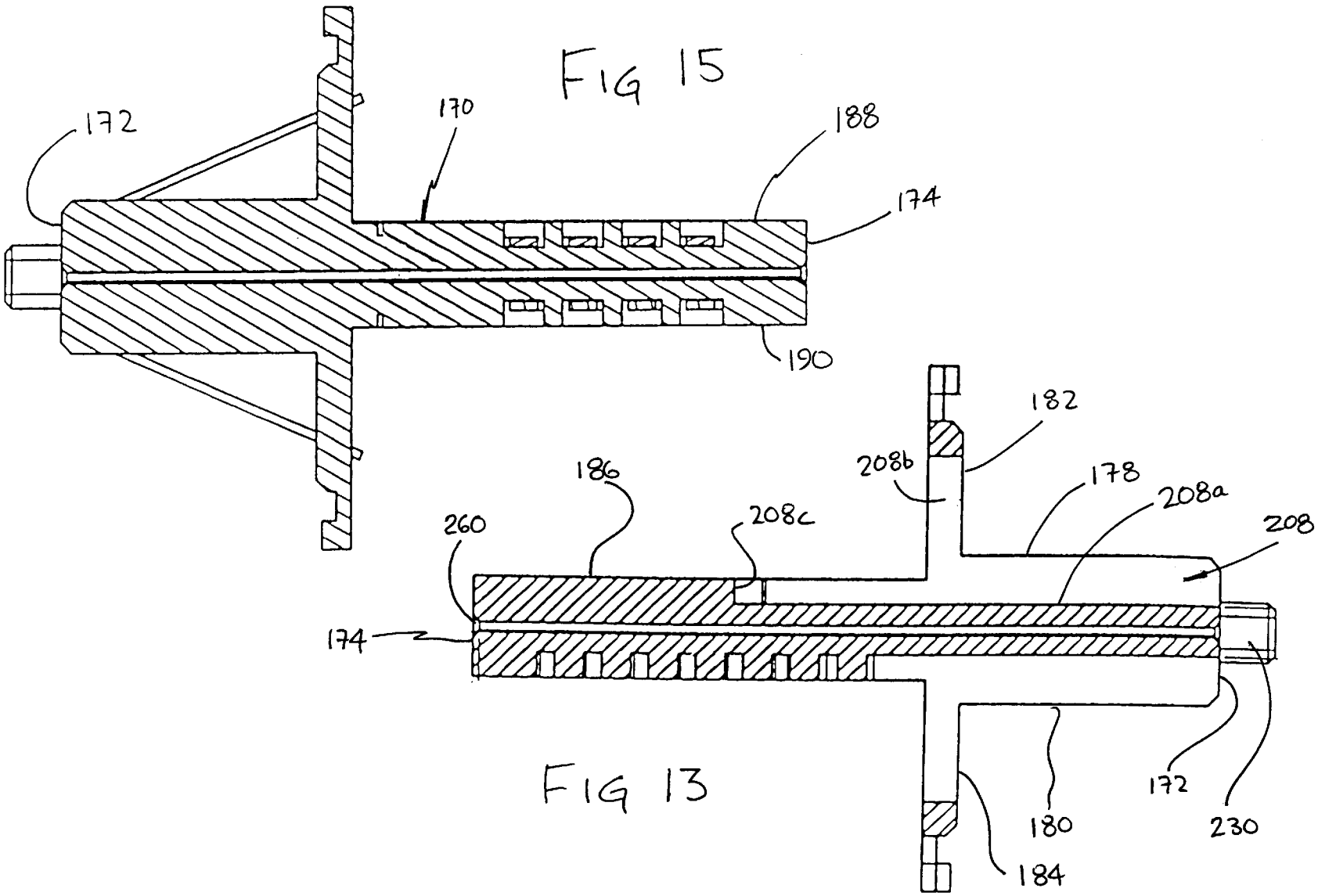
FIG. 13 is a cross-sectional view through lines 13—13 of FIG. 10.
FIG. 15 is a cross-sectional view through lines 15—15 of FIG. 14.

Finally, housing member 26, as best shown in FIGS. 11 and 13, includes an elongate slot member 260 which extends transversely across the terminal receiving slots 201–208 (FIG. 11) and extends between front face 172 and rear face 174 (FIG. 13). As shown best in FIG. 11, the slot 260 includes a plurality of gripping detents 262 positioned on both the top and bottom surfaces of the slot 260.

Figure 14:
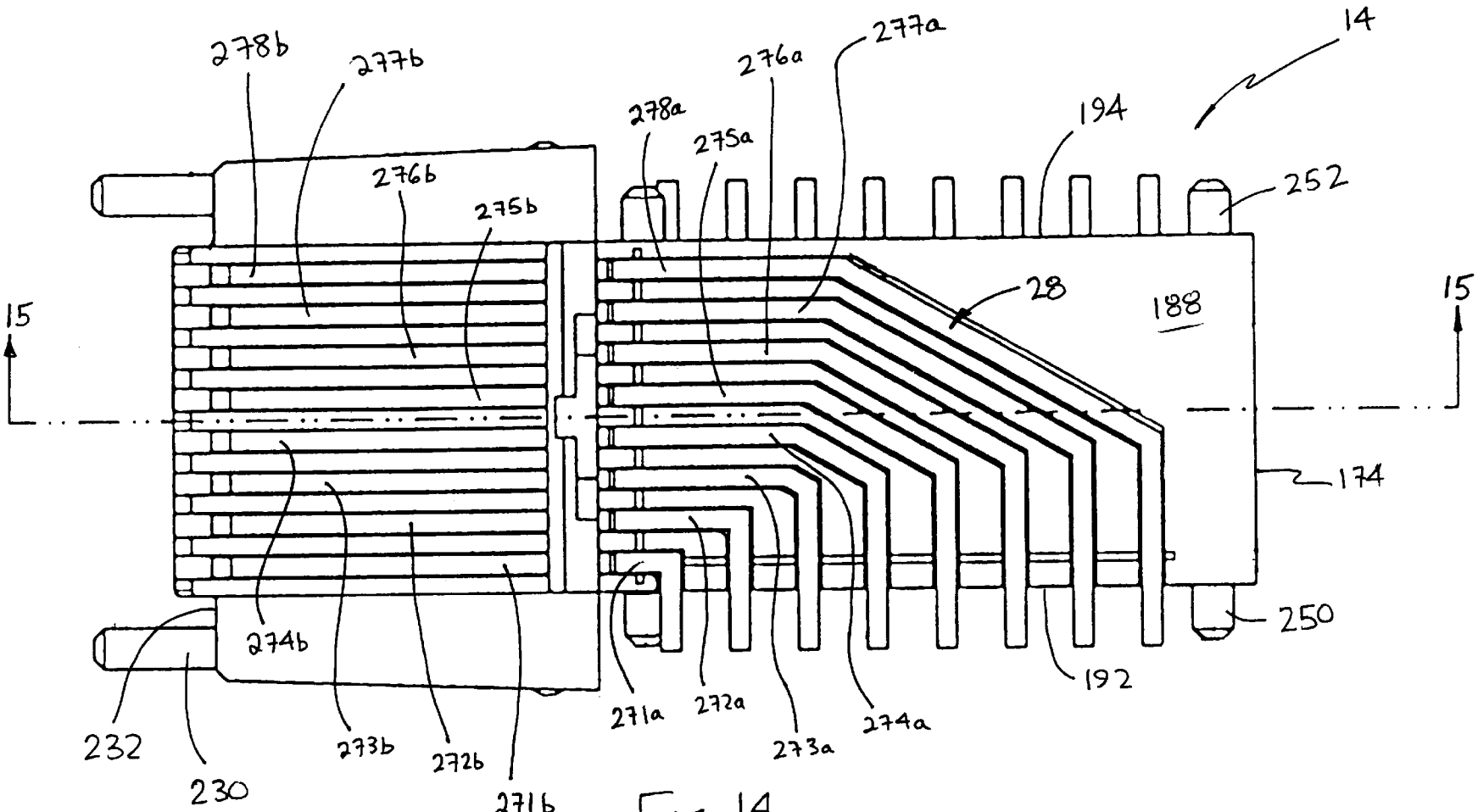
FIG. 14 is a top plan view of the modular jack subassembly shown in FIG. 9.

With reference now to FIGS. 9 and 14, the plurality of electrical terminals 28 will be described in greater detail. With reference first to FIG. 14, the contacts are defined as modular jack contacts, and are stamped and formed from a blank sheet of metal in a lead frame approach such that the terminals are formed, at one end, into right angles for interconnection to a printed circuit board. Thus, the terminals 28 have base portions 271A–278A, which vary in length due to their right-angled nature as is well known in the art. These base portions 271A–278A are positioned within respective channels 201A–208A in the housing (FIG. 10). As shown in FIG. 14, the terminals 28 also include a plurality of reversely bent contact portions, 271B–278B, which reversely bend and extend obliquely rearwardly away from the front face 172 of the modular jack housing 14. These reversely bent portions 271B–278B extend through their associated upstanding slots 201B–208B to provide lateral alignment thereof, and are spring loaded there against. The terminals are thereafter transitioned into printed circuit board contacts 271D–278D as shown in FIG. 9 and extend beyond transverse face 192. While only one side of the connector housing 14 is disclosed, it should be realized that both the connector channels as well as the terminals are identical, but that they are mirror images of each other such that the printed circuit board terminals, such as 271D–278D, extend beyond transverse face 194 as shown in FIGS. 14 and 15.

Figure 19:
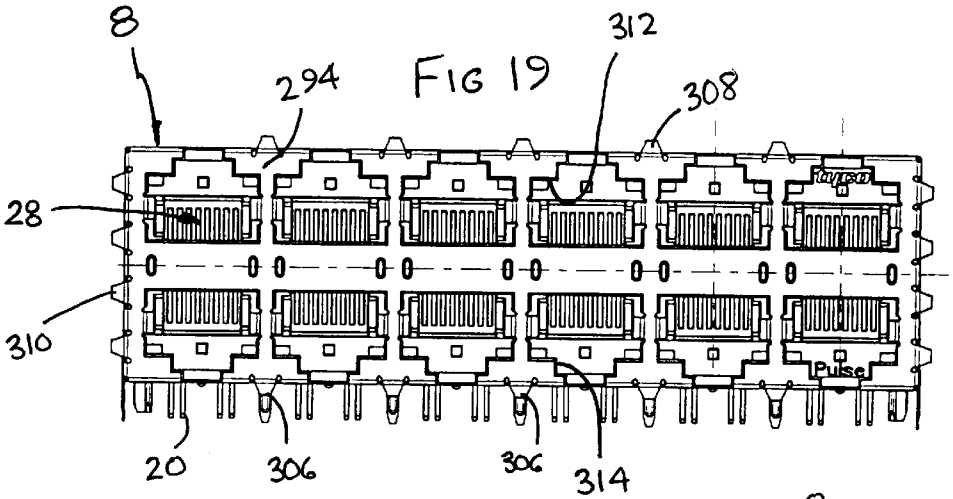
FIG. 19 is a front plan view of the completed assembly.
Figure 20:
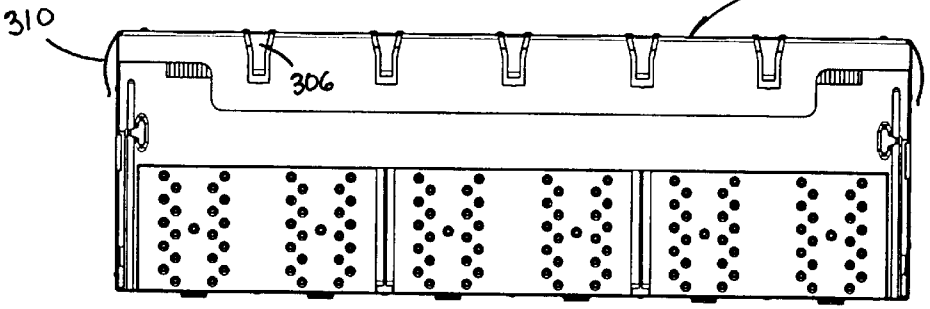
FIG. 20 is a lower plan view of the assembly shown in FIG. 19.
Figure 21:
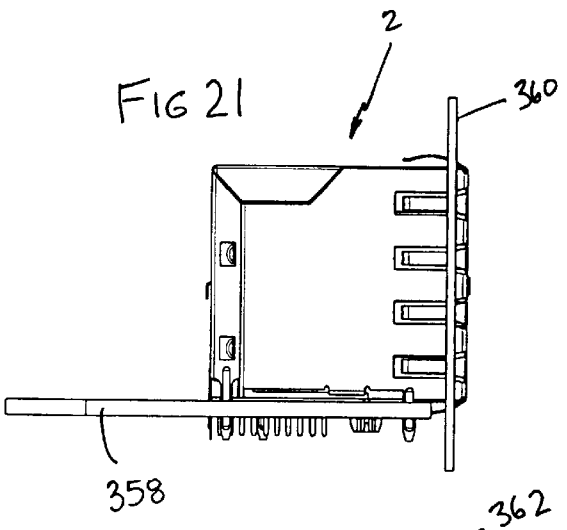
FIG. 21 is a side plan view of the assembly of FIG. 19, with the assembly mounted within a panel opening.
Figure 22:
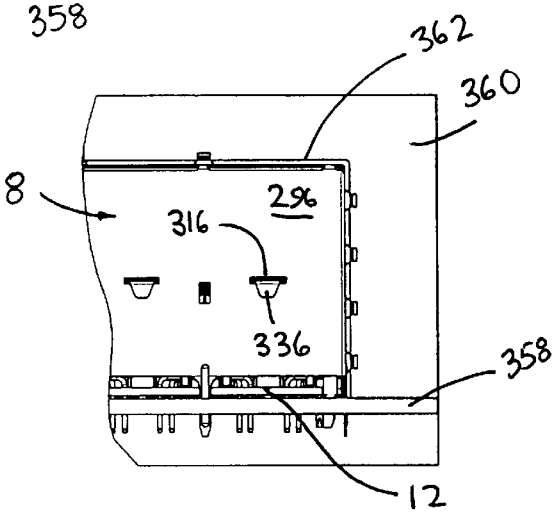
FIG. 22 is a rear plan view of the assembly shown in FIG. 20 in partial fragmentation.

With reference now to FIG. 16, the outer shield member 8 is comprised of a box-shaped stamped and formed metallic enclosure formed by a top wall 290, side walls 292, a front mating face 294, a rear wall 296, and a lower wall 298. It should be understood that this shield in the preferred version of the embodiment is stamped and formed from a single flat piece of sheet metal, however, any type of shield could be employed. As viewed in FIG. 16, the rear wall 296 is shown integrally connected to top wall 290, and is shown in the position ready to receive the housing 6, and is therefore rotatable about the hinged connection at 300. It should be understood that the shield 8 is intended for mounting to a printed circuit board, and therefore side walls 292 include integral printed circuit board tines 302, rear wall 296 includes a plurality of printed circuit board tines 304, and front wall 294 includes printed circuit board tines 306 (FIG. 19). It should also be understood that the shield 8 is intended for receipt within a panel opening and therefore includes a plurality of resilient fingers, such as fingers 308 integrally connected to top wall 290 and fingers 310 integrally connected to side walls 292. Furthermore, the shield 8, as shown in FIG. 19, includes a plurality of stamped openings 312 and 314 which generally conform to the geometry of openings 40 and 42 (FIG. 4A) in the housing 6. Furthermore, rear wall 296 (FIG. 16) includes a plurality of horizontal slots at 316 as will be described in greater detail herein.

With reference now to FIG. 17, shield member 10 is shown as including a generally rectangular metallic member 320 having tabs 322 and 324 extending from a front edge thereof. Also as shown in FIG. 18, a shield member 330 is shown including a rectangular metallic member 332 having ears 334 bent from an edge together with a foldable tab at 336.

With the various components of the assembly as described above, the assembly of the various components will now be described in greater detail. With reference first to FIG. 2, the connector member 24 is first assembled such that the plurality of terminals are positioned in their respective channels with the reversely bent contact portions extending through their respective slots. As shown in FIG. 2, this positions the plurality of printed circuit board terminals 271D–278D (FIG. 9) beyond the transverse faces 192, 194. The various signal conditioning subassemblies 16 are now assembled by positioning the various components 22, 24 on, or through, the board 18 flanking the through holes 25.

Figure 2A:
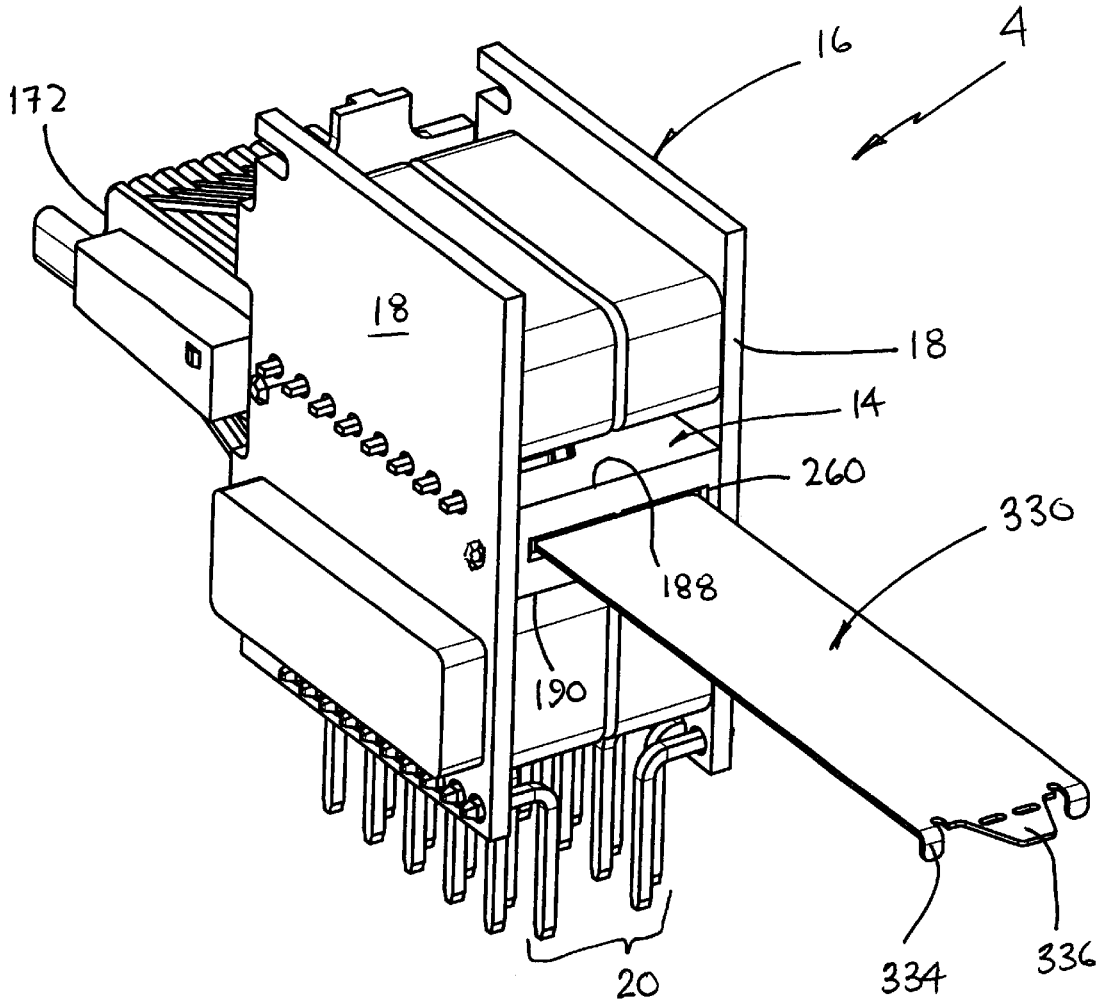
FIG. 2A is an enlarged perspective view of the connector subassembly of FIG. 2 assembled.

It should be appreciated that the through holes 25 are plated through holes such that the printed circuit board terminals 271D–278D can be solder connected to the through holes 25 for electrical connection therewith. It should also be appreciated that through holes 25 are electrically connected to circuit traces (not shown) on the boards 18 which thereafter interconnect with the signal conditioning components 22, 24. These components thereafter are interconnected to plated through holes 21, again by circuit traces on the board 16. Right-angle terminals 20 are thereafter interconnected to through holes 21, preferably by a soldering process to electrically connect the terminals 20 to the printed circuit board 18. It should therefore be appreciated that the plurality of modular jack terminals 28 are electrically connected to the right-angle terminals 20, through the serially connected components 22, 24. The assembled view of the modular jack subassembly 4 is shown in FIG. 2A. As is apparent, due to the low profile nature of the housing 26, particularly above and below surfaces 188, 190, a large volume of space is allotted for the signal conditioning components. The modular jack assembly 4 is completed by positioning the isolation shield 330 within its corresponding slot 260 and sliding the shield to a position adjacent the front face 172.

With the modular jack subassemblies, as described, they are insertable within the connector housing member 6. The subassemblies 4 are positioned within the various cavities so as to align the extension members 220 (FIG. 9) with the tapered slot 74, while at the same time aligning the front edge of edge cards 18 with the various associated slots 100, 116 (FIG. 7). It should also be appreciated that this will position the contoured wall portion 240 within its corresponding opening 150 (FIG. 7) and lug 242 will be positioned within corresponding opening 152. It should also be appreciated that, when the modular jack subassembly 4 is fully inserted within the housing 6, oval-shaped heat stake lugs 230 will extend through their corresponding openings 78 and extend beyond the front face of housing 6. Thus, these lugs can be heat staked with the plastic material melting to form a plastic head within the surrounding opening 166 (FIG. 4A).

The shield members 10 may now be installed intermediate adjacent modular jack assemblies 4, such that the shield 10 is aligned with intermediate slot 112 (FIG. 7) which will also position extension 324 within its corresponding slot 140 (FIG. 3A). Alignment plates 12 may now be slidably received over adjacent subassemblies 4, such that apertures 350 slidably receive over contacts 20, and aperture 352 is slidably received to a position where it is received over lug 125 (FIG. 3A). It should be appreciated that the shield member 8 is now receivable over the above assembly of the modular jack assemblies 4 and housing 6 to the position shown in FIG. 19. In this position, the housing 6 is substantially enclosed by the outer shield member 8. This also provides that the openings 312, 314 correspond with the openings into housing 6, such that modular plugs could be received therein for contact with terminals 28. Finally, the tab 336 of the isolation shield 332 is bent downwardly so as to make grounding contact with rear wall 296 of the shield member 8.

As assembled, the connector 2 is positionable on a printed circuit board 358 with the various terminals 20 aligned and electrically connected with corresponding through holes in the circuit board 358. This entire subassembly is connectable to a panel 360 through an aperture 362 thereof.

What is claimed is:

1. An electrical connector assembly, comprising:

a housing member having a front mating face having at least two openings therethrough, profiled to receive a plurality of electrical plugs, wherein said openings are positioned one above the other;

a jack portion comprised of an elongate beam section having a front face, rear face, top and bottom faces and side edges, transverse walls upstanding from said top and bottom faces, the top and bottom faces including terminal receiving channels therein, extending through said transverse walls, with vertical slots extending into said top and bottom transverse walls and communicating with said channels; and a plurality of electrical terminals positioned in said channels, having base portions lying in said channels substantially parallel to said top and bottom faces and extending through said transverse walls, with contact portions being reversely bent adjacent to said front face and extending rearwardly and being laterally aligned within said vertical slots;

said jack portion, together with said terminals, being receivable within said housing member, with said upper row of contact portions positioned adjacent to said upper opening, and said lower row of contact portions adjacent to said lower opening.

2. The connector assembly of claim 1, wherein said vertical slots extend only partially the length of said transverse walls, thereby forming stop surfaces for said contact portions, and said contact portions are spring-biased against said stop surfaces.

3. The connector assembly of claim 1, wherein said connector housing member includes inner side walls flanking said openings, said side walls having slots profiled to receive portions of said jack portion side edges for aligning said jack portion and said terminals with said openings.

4. The connector assembly of claim 3, wherein said side edges include extension portions profiled for receipt within said slots.

5. The connector assembly of claim 4, wherein said extension portions have side edges tapered towards said jack portion front face.

6. The connector assembly of claim 4, wherein said extension portions have top and bottom surfaces which together taper towards said jack portion front face.

7. The connector assembly of claim 4, wherein said extension portions include a retaining lug extending forwardly therefrom and said housing front mating face including receiving openings for receipt therethrough of said retaining lugs.

8. The connector assembly of claim 7, wherein said retaining lugs are adapted for heat staking said jack portion to said housing.

9. An electrical connector assembly, comprising:

a housing member having a front mating face having at least two openings therethrough, profiled to receive a plurality of electrical plugs through said front mating face, and said openings being profiled one above the other;

a jack portion comprised of an elongate platform beam section having a substantially rectangular profile, said jack portion having top and bottom surfaces having terminal receiving channels therein;

a plurality of electrical contacts positioned in said terminal receiving channels, with contact portions adjacent a front end of said platform beam section, and rear contact sections being positioned substantially within the profile of said terminal receiving channels;

said jack portion being receivable within said housing member, thereby defining cavities above and below said platform beam section, and between said housing member, for receiving circuit components connection with for said contacts.

10. The electrical connector assembly of claim 9, wherein said housing member includes a plurality of columns of openings arranged in laterally spaced positions, with a like plurality of jack portions aligned with corresponding openings.

11. The electrical connector assembly of claim 9, wherein the housing member includes an intermediate wall parallel with said housing front mating face, and said platform beam section being receivable within said housing member, whereby plug receiving cavities are defined above and below said platform beam section, between said mating face and intermediate wall, and said circuit components receiving cavities being defined above and below said platform beam section, between said intermediate wall and a rear face of said housing member.

12. The electrical connector assembly of claim 9, wherein said plug receiving cavities are further defined by side walls extending forwardly from said intermediate wall.

13. The electrical connector assembly of claim 12, wherein said side walls have slots profiled to receive portions of said jack portion side edges for aligning said jack portion with said openings.

14. The electrical connector assembly of claim 13, wherein said side edges include extension portions profiled for receipt within said slots.

15. The electrical connector assembly of claim 14, wherein said extension portions have side edges tapered towards said jack portion front face.

16. The electrical connector assembly of claim 15, wherein said extension portions have top and bottom surfaces which together taper towards said jack portion front face.

17. The electrical connector assembly of claim 16, wherein said extension portions include a retaining lug extending forwardly therefrom and said housing front mating face including receiving openings for receipt therethrough of said retaining lugs.

18. The electrical connector assembly of claim 17, wherein said retaining lugs are adapted for heat staking said jack portion to said housing.

19. An electrical connector assembly, comprising:

a housing member having a front mating face having at least two openings therethrough, profiled to receive a plurality of electrical plugs through said front mating face, and said openings being profiled one above the other;

a jack portion comprised of an elongate platform beam section having a substantially rectangular profile, said jack portion having top and bottom surfaces having terminal receiving channels therein, and a shield receiving slot extending within said platform beam section, extending the substantial length of said platform beam section;

a plurality of electrical contacts positioned in said terminal receiving channels defining upper and lower rows of contacts, with contact portions adjacent a front end of said platform beam section; and an isolation shield receivable within said shield receiving slot to isolate electromagnetic interference between said upper and lower rows of contacts.

20. The electrical connector assembly of claim 19, further comprising an outer shield member substantially surrounding said housing member, with openings through said outer shield member, in alignment with said plug receiving openings.

21. The electrical connector assembly of claim 20, wherein said outer shield member is electrically connected to said isolation shield.

22. The electrical connector assembly of claim 21, wherein said shield member includes a front shield wall, top shield wall, side shield walls, and a rear shield wall.

23. The electrical connector assembly of claim 22, wherein said isolation shield includes a tab contact receivable within a slot in said rear shield wall.

24. The electrical connector assembly of claim 22, wherein said housing member includes a plurality of columns of openings arranged in laterally spaced positions, and further comprising a like plurality of jack portions aligned with corresponding openings.

25. The electrical connector assembly of claim 19, wherein the housing member includes an intermediate wall parallel with said housing front mating face, and said platform beam section being receivable within said housing member, whereby plug receiving cavities are defined above and below said platform beam section, between said mating face and intermediate wall, and circuit components receiving cavities being defined above and below said platform beam section, between said intermediate wall and a rear face of said housing member.

* * * * *